US005618061A

United States Patent [19]

Ritterling

[11] Patent Number: 5,618,061

[45] Date of Patent: Apr. 8, 1997

[54] FOLDER WITH SLIDE-STIFFENER ASSEMBLY

[75] Inventor: Douglas Ritterling, Washington, Mo.

[73] Assignee: American Trading and Production Corporation, Baltimore, Md.

[21] Appl. No.: 531,791

[22] Filed: Sep. 21, 1995

[51] Int. Cl.[6] ..... B42D 1/00

[52] U.S. Cl. ..... 281/15.1; 281/29; 281/36; 402/73; 402/80 R; D19/26; D19/32

[58] Field of Search ..... 281/15.1, 29, 33, 281/40, 36, 37, 31, 42, 45; 402/73, 80 R, 4; D19/26, 32

[56] References Cited

U.S. PATENT DOCUMENTS

| | | | |
|---|---|---|---|
| 520,171 | 5/1894 | Thompson | 281/37 |
| 985,237 | 2/1911 | Waterhouse | 402/73 X |
| 1,037,024 | 8/1912 | Krumming | 281/29 |
| 1,073,418 | 11/1913 | Krumming | 402/73 X |
| 3,707,259 | 12/1972 | Meyer | 229/92.5 |
| 4,552,479 | 11/1985 | Nickow et al. | 281/33 X |
| 5,037,136 | 8/1991 | McIntire | 281/36 X |
| 5,417,456 | 5/1995 | Laubacher | 281/45 |
| 5,421,616 | 6/1995 | Laubacher | 281/45 |

*Primary Examiner*—Frances Han
*Attorney, Agent, or Firm*—Cohn, Powell & Hind, P.C.

[57] ABSTRACT

This folder (10) includes covered pocket portions (12, 14) connected by a spine (16) and each separately reinforced. The reinforcing for one portion (12) includes a slide-stiffener assembly (20) and the reinforcing for the other portion includes at least one stiffener (160, 260) separated from the slide-stiffener assembly (20). The slide-stiffener assembly (20) includes a base unit (22) housing a sliding extension member (40) which can be extended to bridge the spine (16) to hold the two pocket portions (12, 14) in an open position and provide a rigid writing surface and retracted to permit the folder (10) to be folded for storage by the user.

15 Claims, 3 Drawing Sheets

FOLDER WITH SLIDE-STIFFENER ASSEMBLY

BACKGROUND OF THE INVENTION

This invention relates generally to folders and in particular to a wallet type folder having a slide-stiffer assembly for holding the folder in the open position to provide a rigid writing surface.

Folders for holding papers such as restaurant receipts, golf score cards and similar items should be small enough to fold to a size which permits the folder to be kept in a pocket of a user. Such folders should also be large enough to hold the item in a position convenient for signing. Conventional folders which are small enough when doubled over to store in the pocket of the user are not large enough in the folded position to provide a large enough writing surface. However, when opened up they tend to bend along the spine and do not provide a convenient writing surface.

This folder solves this and other problems in a manner not revealed by the known prior art.

SUMMARY OF THE INVENTION

This invention provides a folder which is small enough in the closed position to store in a pocket and stiff enough in the open position to provide a suitably large and rigid writing surface.

This folder includes a retractable slide-stiffener assembly which bridges the spine of the folder to hold it in the open position so that it can be used, for example, by crossword puzzle enthusiasts, even while the user is in a standing position.

This improved wallet folder with stiffening assembly for holding the folder in an open position comprises a first pocket portion, a second pocket portion, a spine means connecting said first pocket portion to said second pocket portion, and a stiffening assembly including a base member disposed in said first pocket portion, and an extension member disposed in sliding relation to said base member for sliding movement of said extension member from said first pocket portion into said second pocket portion in bridging relation to said spine means to hold said first and second pocket portions in an open position.

It is an aspect of this invention to provide that said base member includes a pair of members sandwiching said extension member, and said extension member includes means for moving said extension member outwardly of said sandwiching members.

It is another aspect of this invention to provide that one of said sandwiching members includes a slot, and said means for moving said extension member includes a button means attached to said extension member and projecting through said slot in said sandwiching member.

It is still another aspect of this invention to provide that said first pocket portion includes a slot, and said means for moving said extension member includes a button means attached to said extension member which projects through said slot.

It is another aspect of this invention to provide that said stiffening assembly includes first and second stop means engageable by said extension member determining the amount of extension and retraction of said tongue member.

It is an aspect of this invention to provide that said base member includes a guide frame having an open end and a closed end and a pair of members sandwiching said frame, and said extension member includes an inner stop member and an outer tongue member received in sliding relation by said open end.

It is yet another aspect of this invention to provide that a stiffener member is disposed adjacent said second pocket portion.

It is an aspect of this invention to provide that a guide member is disposed between said first pocket portion and said second pocket portion and across said spine portion receiving said extension member in guided relation, and another aspect that said guide member is a plastic film extending from an inside face of the base member in the first pocket portion, to an outside face of the stiffener member in the second pocket portion.

It is another aspect of this invention to provide that the folder includes an intermediate portion housing the stiffening assembly and cover means for intermediate portion.

It is yet another aspect of this invention to provide that said cover means includes inner and outer cover portions, each having first and second pocket portions adjacent said corresponding pocket portions of said intermediate portion and another aspect to provide that each inner and outer cover portion includes a reinforcing member in said second pocket portion.

It is still another aspect of this invention to provide that said extension member includes push means, and one of said base means sandwich members includes a slot and said outer cover portion includes a slot, said slots providing access to said push means.

This folder with slide-stiffener assembly is inexpensive to manufacture, simple to use and is very effective for its intended purpose.

DESCRIPTION OF THE PREFERRED EMBODIMENT

Figures 1, 2, 3:
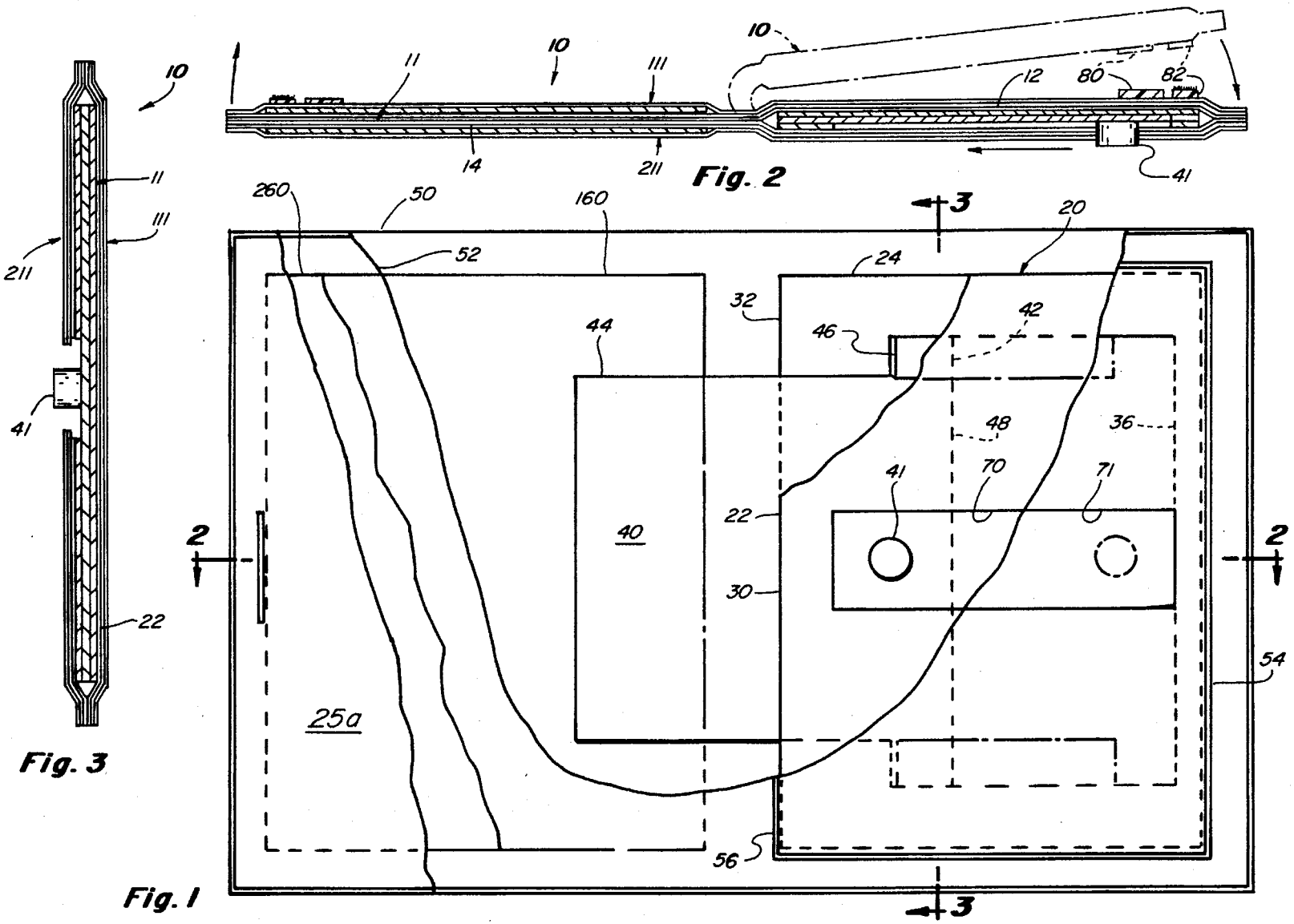
FIG. 1 is a fragmentary elevational view of the folder with the cover removed in part and with the slide assembly extended.
FIG. 2 is a sectional plan view taken on line 2—2 of FIG. 1 but with the slide assembly retracted.
FIG. 3 is a cross-sectional view taken on line 3—3 of FIG. 1.

Referring now by reference numerals to the drawings, and first to FIGS. 1–3 and 6, it will be understood that the folder 10 includes an intermediate portion 11 and opposed sandwiching portions providing inner and outer cover portions 111 and 211 constituting cover means. The intermediate portion 11 provides a first pocket portion 12 and a second pocket portion 14 separated by a center portion 16. In the embodiment shown, the pocket portions and the center portion are formed from single ply sheets of plastic 50 and 52, such as polyvinyl-chloride (PVC), heat sealed around the margins.

Figure 10:
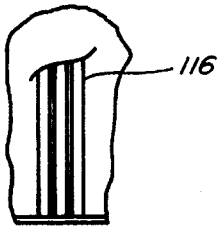
FIG. 10 is a detail showing the spine arrangement of the inner cover portion.

The inner cover portion 111 also includes a first pocket portion 112 and a second pocket portion 114 separated by a center portion 116. The inner cover portion is similarly formed from single ply sheets 150 and 152 heat sealed around the margins and also heat-scored down the center portion 116, as shown in FIG. 10. The outer cover portion 211 also includes a first pocket portion 212 and a second pocket portion 214 separated by a center portion 216. The outer cover portion 211 is similarly formed from single ply sheets 250 and 252 heat-sealed around the margins and also heat scored down the center portion 216, as shown in FIG. 1. The heat scoring down the center portions 116 and 216 seals the plies together and provides a spine portion to facilitate folding to the position shown in phantom outline in FIG. 2.

The intermediate portion 11 is not sealed down the center portion 16 so that the pocket portions 12 and 14 communicate with each other and accommodate a slide-stiffener assembly 20 located in pocket portion 12, and extendible into pocket portion 14, as will now be described.

Figure 7:
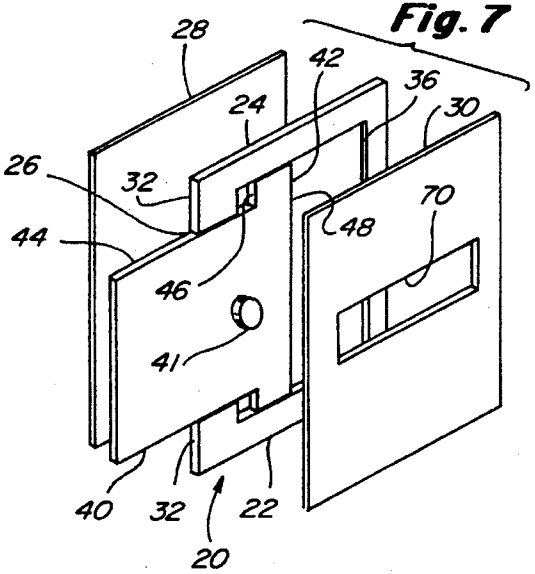
FIG. 7 is a schematic, exploded, perspective view of the slide assembly.
Figure 8:
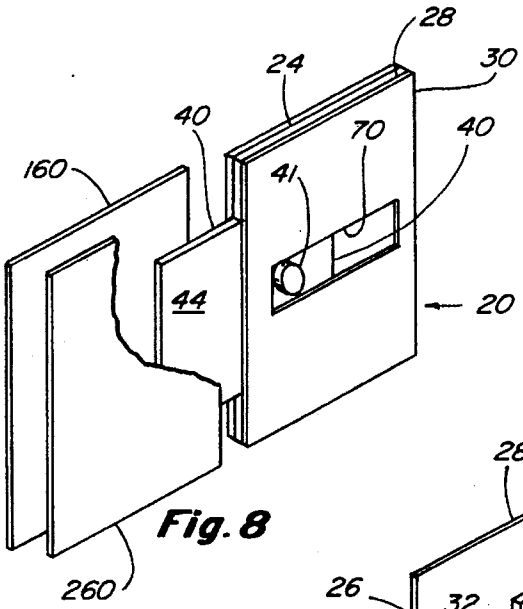
FIG. 8 is a schematic, perspective view of the slide assembly showing the reinforcing members of the inner and outer portions.

As best shown in FIGS. 7 and 8, the slide-stiffener assembly 20 generally indicated by numeral 20 can be extended and retracted. The assembly permits the folder 10 to be folded into a closed position in which the pocket portions 12 and 14 overlie each other and are of a convenient size to be stored in a user's inside jacket pocket or a purse, and yet be opened and maintained and locked rigid in an open position by simple slide action of an internal stiffener arrangement operated from the outside of the folder.

The slide-stiffener assembly 20 includes a base unit 22, receiving an extension member 40 in sliding relation and providing a housing for said extension member. The base member 22 includes a frame member 24 having an opening 26 at one end, and a pair of sandwiching reinforcing stiffener members 28 and 30 peripherally attached to the frame member 24, as by adhesive, to form a partially closed unit. The extension member 40 includes an inner stop member 42 and an outer tongue member 44. The tongue member 44 is received through the frame end opening 26 and can be slidingly extended outwardly until the inner stop member abutment 46 engages the outer stop means provided by the short frame members 32. The extension member 40 can be retracted inwardly until the inner stop member abutment 48 engages the inner stop means provided by the elongate frame member 36. The extension member 40 includes a button 41 which provides a push means for moving the extension member 40 from the retracted position to the extended position. To permit the button 41, and therefore the extension member 40, to be pushed back and forth, the slide assembly reinforcing member 30 includes a slot 70 and the first pocket portion ply 52 also includes a slot 71.

Figure 9:
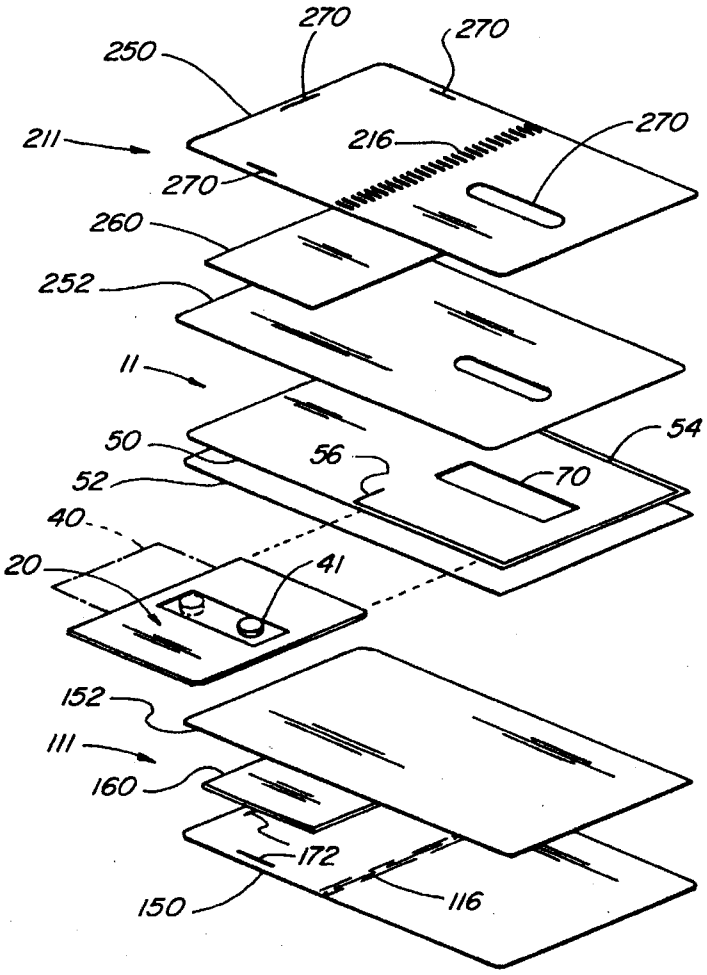
FIG. 9 is an exploded perspective view showing the intermediate, inner and outer portions of the folder.

As best shown in FIGS. 1 and 9, sandwiching plies 50 and 52 the intermediate folder portion 11 are heat sealed together around the base unit 22 of the slide assembly 20 as by a generally U-shaped heat seal 54 cooperating with reentrant heat seals 56 to retain the base unit 22.

Figures 4, 5, 6:
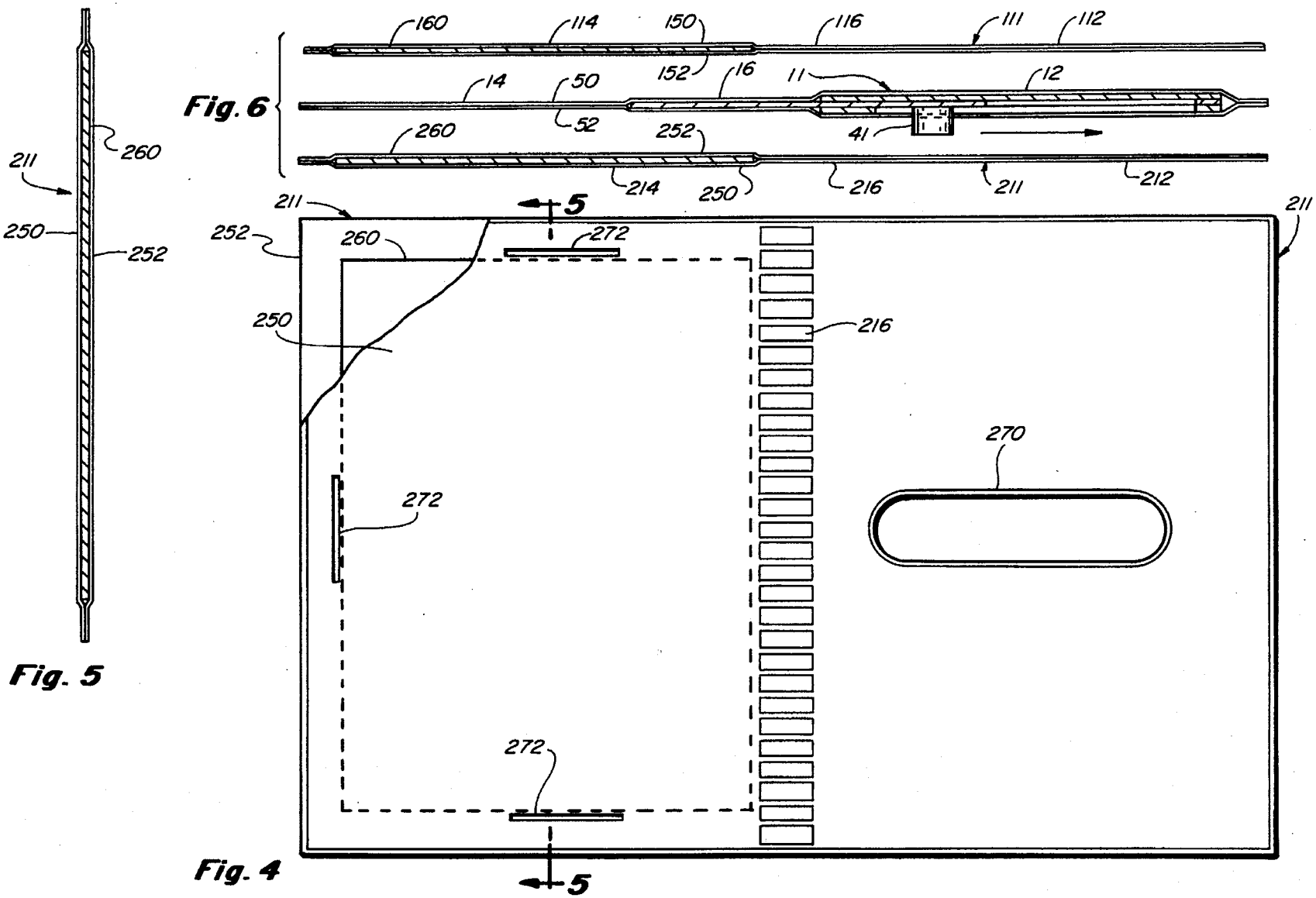
FIG. 4 is an elevational view of the outer cover portion of the folder.
FIG. 5 is a cross-sectional view taken on line 5—5 of FIG. 4.
FIG. 6 is an exploded, cross-sectional plan view showing the intermediate, inner and outer portions of the folder.

The inner and outer portions 111 and 211 are reinforced to stiffen the folder in the areas on the other side of the center portions 116 and 216. To this end, a reinforcing member 160, as shown in FIGS. 1 and 6, is provided in the pocket portion 114 of the inner portion 111 and a reinforcing member 260 is provided in the pocket portion 214 of the outer portion 211. The reinforcing members 160 and 260 are retained on three sides by bar seals and on the side adjacent the spine, by the center seal. This arrangement is typical for both the inner and outer portions and is shown with respect to the outer portion in FIG. 4. The inner and outer portions are distinguished in that both plies 250 and 252 of the outer portion 260 are provided with a heat-sealed cut-out slot 270 to receive the button 41 of the slide assembly extension member 40. The slots 70, 71 and 270 permit the button 41 to be accessible from the outside of the folder.

In the embodiment shown, the sandwiching stiffeners 28 and 30, the frame member 24 and the extension member 40, and also the opposing stiffeners 160 and 260 are formed from chipboard material. The board member 24 in the embodiment shown is 39 pt. chipboard and the sandwiching boards 28 and 30 are 19 pt. chipboard. The reinforcing members 160 and 260 are 18 pt. chipboard.

For convenience in holding a paper, such as a receipt, in place for signature, and as best shown in FIG. 2, the inner cover portion 111 may include elongate retaining members 80 at each end of the folder 10, preferably of clear plastic, heat sealed to at each end to said inner cover portion. Also, in order to keep the folder 10 in the closed position when not being used, mating pieces of Velcro fastener material, indicated by numeral 82, may be provided at each end of the folder 10.

It is thought that the structural features and functional advantages of this folder 10 have become fully apparent from the foregoing description of parts. However, for completeness of disclosure, the operation of the folder will be briefly described.

The folder 10 includes an intermediate portion 11 and inner and outer reinforced cover portions 111 and 211 respectively, which are peripherally heat sealed together. The intermediate portion pocket 12 houses the slide assembly 20 and pocket 14 communicates with the pocket 12 so that the extension tongue 44 can bridge the gap defined by the center spine portion 16. The inner and outer portions 111 and 211 are provided with opposed reinforcing members 160 and 260 and the bridging tongue 44 extends in overlapping relation with the reinforcing members 160 and 260. The reinforcing provided by the base unit 22 on the other side of spine completes the stiffening of the entire wallet 10. Because of this arrangement, the folder can readily be folded about the spine 16, 116, 216 for storage and opened for use as a writing or viewing surface. In the open position, the two pocket portions 12 and 14 are substantially in the same plane so that the extension member tongue 44 can be slid outwardly from the base member 22 across the spine 16 by pushing the button 41 until the extension member 40 engages the stop members 32 provided by the frame 24. This action is facilitated by the continuous film sheets 50 and 52, which provide a guide to ease the tongue 44 over any discontinuity provided by the separated stiffener assembly 20 and the individual stiffeners 160 and 260 respectively. When the use of the folder is completed it is a simple matter to push the button 41 rearwardly to retract the extension member tongue 44 into the housing provided by the base member 22 and out of interference with the spine 16 to permit the folder 10 to be doubled up into the closed position for storage.

Also, although the improved folder has been described by making particular reference to a preferred construction, the details of description are not to be understood as restrictive, numerous variants being possible within the principles disclosed and within the fair scope of the claims hereunto appended.

I claim as my invention:

1. A folder with stiffening assembly for holding the folder in an open position, the folder comprising:

(a) a first pocket portion, a second pocket portion, a spine means connecting said first pocket portion to said second pocket portion, and (b) a stiffening assembly including a base member disposed in said first pocket portion, and an extension member disposed in sliding relation to said base member for sliding movement of said extension member from said first pocket portion into said second pocket portion in bridging relation to said spine means to hold said first and second pocket portions in an open position.

2. A folder as defined in claim 1, in which:

(c) said base member includes a pair of members sandwiching said extension member, and (d) said extension member includes means for moving said extension member outwardly of said sandwiching members.

3. A folder as defined in claim 2, in which:

(e) one of said sandwiching members includes a slot, and (f) said means for moving said extension member includes a button means attached to said extension member and projecting through said slot in said sandwiching member.

4. A folder as defined in claim 1, in which:

(c) said first pocket portion includes a slot, (d) said means for moving said extension member includes a button means attached to said extension member and projecting through said slot.

5. A folder as defined in claim 1, in which:

(c) said base member includes a guide frame having an open end and a closed end and a pair of members sandwiching said frame, and (d) said extension member includes an inner stop member and an outer tongue member received in sliding relation by said open end.

6. A folder as defined in claim 5, in which:

(e) said frame includes outer stop means adjacent said frame open end, and (f) said extension member includes stop means engageable with said frame outer stop means to limit extension of said tongue member.

7. A folder as defined in claim 5, in which:

(e) said frame includes inner stop means adjacent said frame closed end, and (f) said extension member includes stop means engageable with said frame inner stop means to limit retraction of said tongue member.

8. A folder as defined in claim 1, in which:

(c) a stiffener member is disposed in said second pocket portion.

9. A folder as defined in claim 1, in which:

(c) a guide member is disposed in said first pocket portion and said second pocket portion and across said spine portion receiving said extension member in guided relation.

10. A folder with stiffening assembly for holding the folder in an open position, the folder comprising:

(a) an intermediate portion including:

(1) a first pocket portion, a second pocket portion, and a spine portion connecting said first and second pocket portions, and (2) a stiffening assembly including a base means disposed in said first pocket portion and having a guide frame with an open end and a closed end and a pair of sandwiching members, and an extension member disposed within said guide frame between said sandwiching members, said extension member including an inner stop member and an outer tongue member and being received in sliding relation to said base member for extension of said tongue member from said first pocket portion over said spine portion into said second pocket portion to hold said first and second pocket portions in an open position.

(b) cover means for said intermediate portion.

11. A folder as defined in claim 10, in which:

(c) said cover means includes inner and outer cover portions, each having first and second pocket portions adjacent said corresponding pocket portions of said intermediate portion.

12. A folder as defined in claim 10, in which:

(c) said stiffening assembly includes first and second stop means engageable by said extension member determining the amount of extension and retraction of said tongue member.

13. A folder as defined in claim 12, in which:

(d) a stiffener member is disposed adjacent said second pocket portion, (e) a flexible film is disposed between said first pocket portion and said second pocket portion in extended relation across said spine portion from the first pocket portion to the second pocket portion.

14. A folder as defined in claim 12, in which:

(d) each inner and outer cover portion includes a reinforcing member in said second pocket portion.

15. A folder as defined in claim 14, in which:

(c) said extension member includes push means, and (d) one of said base means sandwich members includes a slot and said outer cover portion includes a slot, said slots providing access to said push means.

* * * * *